US005250999A

United States Patent [19]

Kimura et al.

[11] Patent Number: 5,250,999

[45] Date of Patent: Oct. 5, 1993

[54] IMAGE FORMING APPARATUS HAVING TRANSFER VOLTAGE AND PROCESS SPEED CONTROL

[75] Inventors: Kiyoshi Kimura; Hiroyuki Honda; Toshifumi Isobe, all of Tokyo, Japan

[73] Assignee: Konica Corporation, Tokyo, Japan

[21] Appl. No.: 640,696

[22] Filed: Jan. 14, 1991

[30] Foreign Application Priority Data

Jan. 17, 1990 [JP] Japan ..... 2-7699

[51] Int. Cl.[5] ..... G03G 15/01; G03G 21/00

[52] U.S. Cl. ..... 355/327; 355/273; 355/311; 355/313

[58] Field of Search ..... 355/326, 327, 311, 313, 355/271, 273

[56] References Cited

U.S. PATENT DOCUMENTS

| | | | |
|---|---|---|---|
| 3,851,236 | 11/1974 | Dennhardt et al. | 355/309 X |
| 3,877,416 | 4/1975 | Donohue et al. | 355/273 X |
| 4,549,803 | 10/1985 | Ohno et al. | 355/284 |
| 4,593,992 | 6/1986 | Yoshinaga et al. | 355/311 X |
| 4,719,489 | 1/1988 | Ohkubo et al. | 355/290 |
| 4,928,136 | 5/1990 | Kusumoto et al. | 355/326 X |
| 5,010,370 | 4/1991 | Araya et al. | 355/271 X |
| 5,010,372 | 4/1991 | Kasahara et al. | 355/327 X |
| 5,041,878 | 8/1991 | Takai et al. | 355/326 X |

FOREIGN PATENT DOCUMENTS

| | | |
|---|---|---|
| 0121870 | 5/1988 | Japan . |
| 1-193885 | 8/1989 | Japan . |
| 1-248171 | 10/1989 | Japan . |

*Primary Examiner*—A. T. Grimley
*Assistant Examiner*—Nestor R. Ramirez
*Attorney, Agent, or Firm*—Jordan B. Bierman

[57] ABSTRACT

A color image forming apparatus for forming a toner image on a transparent member used in combination with overhead projectors including a speed switch for switching the process speed while an image carrier is rotating, after toner images of a number of colors are formed on the image carrier; a process control for controlling the transfer conditions under which the toner images are transferred onto the recording medium, in response to switching of the process speed; and a selector for selecting an overhead projection mode including a voltage switch for reducing voltage applied to the transfer device after a predetermined time has elapsed. Preferably, the process control includes a fixing temperature control for controlling the fixing temperature of the recording medium having the toner images transferred thereon.

8 Claims, 5 Drawing Sheets

IMAGE FORMING APPARATUS HAVING TRANSFER VOLTAGE AND PROCESS SPEED CONTROL

BACKGROUND OF THE INVENTION

1. Field of the Invention

The present invention relates to a color image forming apparatus and, more particularly, to a color image forming apparatus which can form a toner image on a transparent member (to be referred to as OHP paper hereinafter) used for an overhead projector (to be referred to as an OHP hereinafter).

2. Description of the Prior Art

In some conventional image forming apparatuses, when an image is to be formed on OHP paper, in order to obtain a clear color image, a linear velocity is decreased to prolong a fixing nip time (Japanese Patent Laid-Open Nos. 60-80885 and 60-86574).

In these conventional apparatuses, formation of an image on a photosensitive member is performed at a normal linear velocity as in image formation on plain paper, and the linear velocity is switched to a low velocity after the trailing end of OHP paper passes through a transfer section.

In the above-mentioned prior art, process conditions need not be switched in the process of forming an image, and hence image irregularity can be prevented. However, the following problems are posed:

(1) Since switching of the linear velocity cannot be properly performed in the process of exposure and developing, velocity switching is executed after transfer of an image onto recording paper is completed. For this reason, the distance between a transfer section and a fixing section must be set to be longer than the length of OHP paper, resulting in an increase in apparatus size.

(2) Since a paper convey mechanism is required between the transfer section and the fixing section, the apparatus is complicated, resulting in an increase in cost.

SUMMARY OF THE INVENTION

The present invention has been made in consideration of the above-described problems of the prior art, and has as its object to provide a compact full color printer and copying machine which can form a clear full color image by using a projector such as an OHP.

According to the present invention, there is provided a color image forming apparatus for overlapping toner images of a plurality of colors on a toner image carrier, transferring the toner images onto a recording medium, and fixing the toner images to obtain a color image, characterized by comprising means for further rotating the toner image carrier after the toner image are formed on the toner image carrier, and switching a process speed during the rotation, and process condition control means for switching at least transfer conditions in accordance with the switching of the process speed.

Y, M, C, and K images are sequentially developed-/overlapped on a toner carrier (to be referred to an a photosensitive drum hereinafter) to form a full color image. Thereafter, the photosensitive drum is rotated once more, and the process speed is switched to a low speed much lower than a normal speed at the fifth rotation. With this operation, the time for recording paper to pass through the fixing section is prolonged so that the smoothness and transparency of a toner can be increased.

In this case, since the process speed is not changed in the process of forming the electrostatic latent images, the image is free from adverse influences, and no complicated process control is required.

Since no long distance need be ensured between the fixing section and the transfer section, unlike the prior art, the present invention is very advantageous in development of a compact apparatus. In addition, since no such a complicated mechanism as a belt conveyer for horizontally conveying recording paper is required, the present invention is advantageous in terms of cost.

Furthermore, process control basically need only change process conditions so as to reliably transfer a voltage, applied to a transfer roller, to an OHP at low speed. When control of conditions for fixing is simultaneously performed, the temperature of a heat roller is switched to a temperature suitable for a fixing nip time so as to promote deformation of a toner and to prevent offset. This temperature switching of the fixing roller is preferably performed at the start time of an OHP mode or prior to the start time. More specifically, since the fixing roller has a large heat capacity, it takes a certain time for the roller temperature to reach a desired temperature range after the switching operation is performed. For this reason, it is most preferable that printing be started when the roller temperature reaches a desired control temperature range upon switching of the roller temperature.

Moreover, since a scorotron electrode is employed as a charge electrode, the surface potential and toner charge prior to transfer can be kept uniform and constant regardless of a change in line speed. Therefore, by switching the transfer roller voltage to a proper value in the above-describe manner, the apparatus can be improved in terms of stability.

DETAILED DESCRIPTION OF THE PREFERRED EMBODIMENTS

An embodiment of the present invention will be described below with reference to the accompanying drawings.

Figure 1:
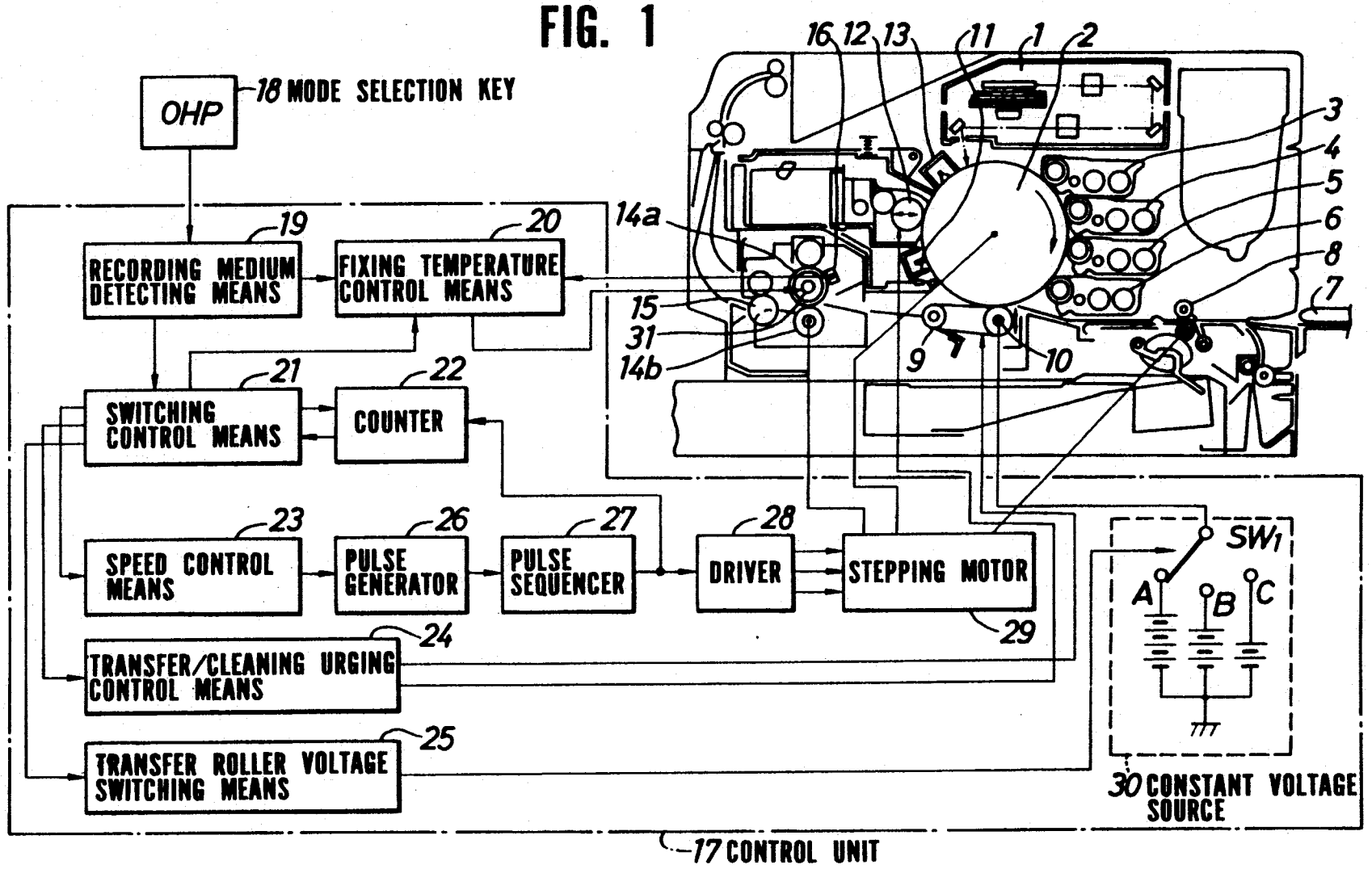
FIG. 1 is a block diagram showing an embodiment of a color image forming apparatus according to the present invention.

FIG. 1 shows an arrangement of a color image forming apparatus according to an embodiment of the present invention.

This embodiment is associated with a full color laser copying machine of a jumping developing scheme which uses four colors, i.e., Y (yellow), M (magenta), C (cyan), and K (black).

In this embodiment, when an image is to be formed on OHP paper, the process speed and fixing temperature are switched under the control of a control unit 17. When OHP paper is selected as recording paper, an operator depresses an OHP mode selection key 18 to switch from a normal mode to the OHP mode.

A fundamental arrangement (operation) of a color copying machine main body will be described below.

Prior to exposure by means of a laser write unit 1, the entire surface of a photosensitive drum (drum diameter: 99.7 mm) 2 is uniformly charged to a predetermined potential by a charge electrode 13. The charge electrode 13 is constituted by a scorotron electrode. A grid voltage of −550 V is set, and the charge potential of the photosensitive drum 2 is set at −600 V. These conditions are not changed regardless of the modes, i.e., the normal mode/OHP mode. Since the scorotron electrode is employed, the surface potential of the photosensitive drum 2 and the toner charge can be kept uniform and constant even if switching of the process speed is performed. This embodiment includes a pre-charge electrode 11 in addition to the charge electrode 13. The photosensitive drum 2 is pre-charged to prevent a potential drop caused by a memory carrier in formation of each color image, thus further stabilizing the surface potential of the photosensitive drum 2.

Electrostatic latent images are sequentially formed on the photosensitive drum 2, which underwent primary charging, by the laser write unit 1. These electrostatic latent images are sequentially developed by Y, M, C, and K developing units 3, 4, 5, and 6. In full color developing, the photosensitive drum 2 is rotated once for each color developing. When the photosensitive drum 2 is rotated a total of four times, toner images of a plurality of colors are overlapped/formed on the photosensitive drum 2.

In the exposure and developing processes, a transfer roller 10 (belt 9) and a cleaning conductive brush (fur brush) 12 are not in contact with each other. When fifth rotation of the photosensitive drum 2 is started, the transfer roller 10 and the cleaning device 12 are urged against each other. The transfer roller and the cleaning device are urged against each other after a multi-color image is completely formed, in order to prevent image fluctuations due to an increase in load during image formation.

A recording paper sheet set in a paper feed tray 7 is fed through second paper feed rollers 8. When the paper sheet passes through the transfer roller 10, the multi-color image is transferred onto the paper sheet at once. The transfer voltage is switched depending on the normal mode or the OHP mode.

The fixing process is performed by using a pair of heat rollers **14*a* and 14*b*. A heater 31 is incorporated in the heat roller 14*a*. The fixing temperature is controlled by changing the operation time of the heater 31. Two types of temperature control are performed: fixed switching control for switching the temperature to a fixed temperature depending on the recording paper mode; and negative feedback control based on an environmental temperature measurement result obtained by a temperature sensor 16**.

After the fixing process, the recording paper sheet is conveyed upward to be discharged through discharge rollers 15.

The control unit 17 will be described below.

The control unit 17 includes a function block (a block formed as a result of operations, of a CPU, performed in accordance with software programs) constituted by a recording medium detecting means 19, a fixing temperature control means 20, a counter 22, a process switching control means 21, a speed control means 23, a transfer/cleaning urging control means 24, and a transfer roller voltage switching means 25. The switching control means 21 systematically controls switching of the process speed and of the transfer roller voltage.

In addition, the control unit 17 includes a driving system block constituted by a three-phase stepping motor 29 (for driving the photosensitive drum 2, the second paper feed rollers 8, the heat rollers **14*a* and 14*b*, and the like), and a driving system (a pulse generator 26, a pulse sequencer 27, and a driver 28) for the stepping motor 29**.

The pulse sequencer 27 receives a pulse train output from the pulse generator 26 and outputs a control pulse for the stepping motor 29 to the driver 28. This control pulse is also supplied to the counter 22. The counter 22 starts counting pulses in response to a command from the switching control means 21, and acknowledges a count value to the switching control means 21. With this operation, the switching control means 21 can detect the rotational amount of the stepping motor 29, and hence can accurately recognize the phase of the photosensitive drum 2 and the position of the recording paper sheet. Upon recognition of a predetermined phase of the drum 2, the switching control means 21 outputs a switching command to the speed control means 23 so as to switch process conditions and the like.

In addition, a constant voltage source 30 is arranged to apply a transfer voltage to the transfer roller 10. A switch SW1 for switching the transfer voltage is arranged in the constant voltage source 30.

When formation of an image on OHP paper is selected by the mode selection key 18, the recording medium detecting means 19 detects this and acknowledges it to the switching control means 21 and the fixing temperature control means 20. In this case, the recording medium detecting means 19 may incorporate a function for automatically detecting the type of a recording medium..

Upon acknowledgement of the OHP mode, the switching control means 21 resets the counter 22 to initialize it, and causes it to start counting the number of control pulses supplied to the stepping motor 29. When the count value reaches a predetermined value, the switching control means 21 causes the speed control means 23 to greatly decrease the process speed, and also causes the transfer roller voltage switching means 25 to switch the transfer voltage to the low voltage side. That is, in response to a command from the transfer roller voltage switching means 25, the switch SW1 of the constant voltage source 30 is switched to a terminal C. With this operation, image transfer suitable for the decrease in process speed is executed.

When fixing temperature control is to be simultaneously performed, the switching control means 21 causes the fixing temperature control means 20 to switch the fixing temperature so as to set an optimal fixing temperature condition. This switching operation is performed prior to the start of copying (printing) operation so that printing is started after the temperatures of the heat rollers **14*a* and 14*b*** reach a desired temperature range.

An operation of this embodiment will be described in detail below with reference to timing charts shown in FIGS. 2 to 5.

In this embodiment, the process speed and transfer conditions are switched as follows:

| | |
|---|---|
| Switching of Speed | |
| normal mode | 75 mm/sec |
| monochrome printing in OHP mode from second rotation to end of printing | 15 mm/sec |
| full color printing in OHP mode from fifth rotation to end of printing | 15 mm/sec |
| Switching of Transfer Conditions | |
| monochrome printing in normal mode | +1.5 V |
| full color printing in normal mode | +2.0 V |
| monochrome and full color printing in OHP mode | +1.0 V |

Figure 2:
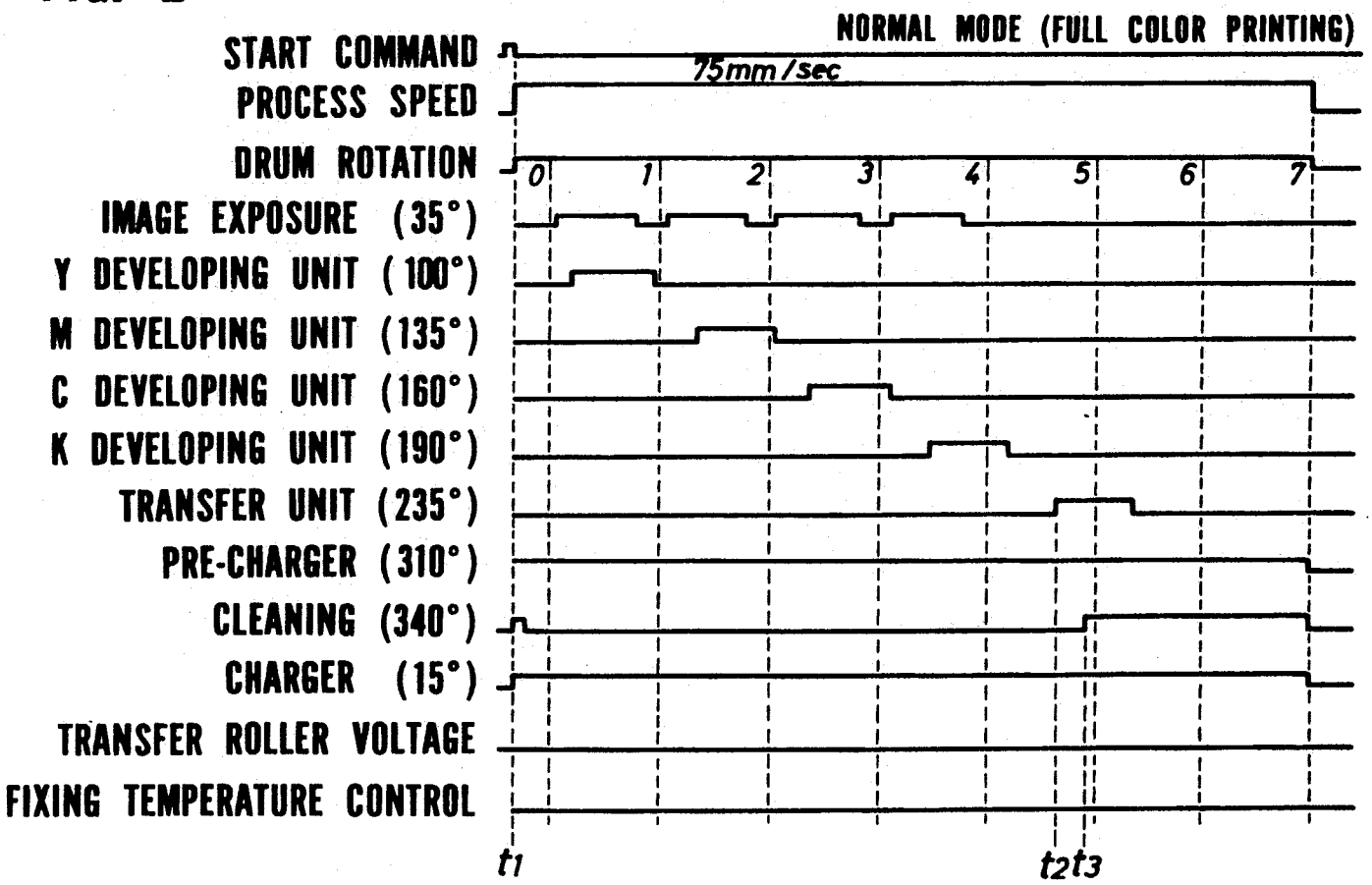
FIG. 2 is a timing chart showing an operation of the apparatus shown in FIG. 1 in a normal mode (full color printing)

FIG. 2 (full color printing in normal mode)

When a transfer key (not shown) is depressed to generate a start command, the photosensitive drum 2 starts rotating at time t1. In response to the command from the switching control means 21, the speed control means 23 controls the process speed to be 75 mm/sec. Since the switch SW1 of the constant voltage source 30 is set at a terminal A (the highest voltage: +2 kV), as shown in FIG. 1, switching of the transfer voltage is not performed.

Y, M, C, and K images are sequentially exposed and developed one by one every time the photosensitive drum 2 is rotated once. When the photosensitive drum 2 is rotated four times, a multi-color image is formed on the drum 2. The grid voltage of the scorotron electrode 13 is −550 V, and the surface potential of the photosensitive drum 2 is 600 V.

The photosensitive drum 2 is further rotated, and the transfer roller 10 is urged against the photosensitive drum 2 at time t2, at which fifth rotation of the drum 2 is performed, under the control of the transfer/cleaning urging control means 24. At time t3 slightly after time t2, the conductive fur brush (cleaning device) 12 is urged against the transfer roller.

The pre-charge electrode 11 and the charge electrode 13 are normally ON. Since the normal mode is set, switching of the fixing temperature is not performed.

Figure 3:
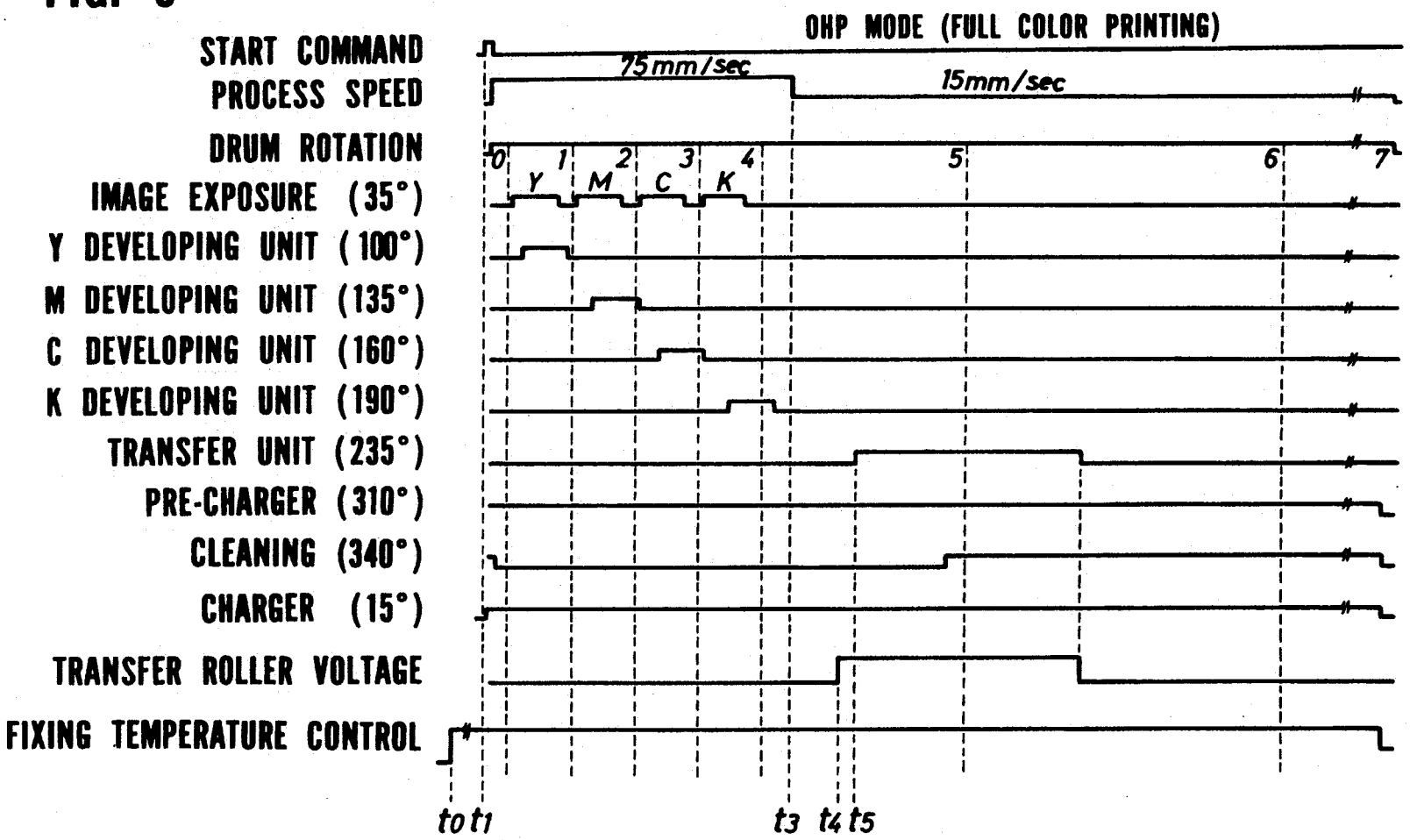
FIG. 3 is a timing chart showing an operation in an OHP mode (full color printing)

FIG. 3 (full color printing in OHP mode)

When the mode selection key 18 is depressed to select the OHP mode, control including a process condition switching operation for an increase in fixing performance is started. More specifically, fixing temperature control is started by the fixing temperature control means 20 at time t0 so as to set an optimal fixing temperature for OHP paper. Since the fixing rollers 14*a* and 14*b* have considerable heat capacities, their temperatures do not immediately reach a desired control temperature range even after switching of the fixing temperature. For this reason, a start command is generated at time t1 when the roller temperature reaches the desired temperature range, thus starting a printing operation.

The exposure and developing processes are performed in the same manner as in the case described with reference to FIG. 2. However, during fifth rotation of the photosensitive drum 2 after a multi-color image is formed, the process speed is switched from 75 mm/sec to 15 mm/sec at time t3. That is, the process speed is greatly decreased.

At time t4, the switch SW1 of the constant voltage source 30 is switched to the terminal C (+1.0 kV) under the control of the transfer roller voltage switching means 25. At time t5, an urging operation of the transfer roller 10 is performed.

Figure 4:
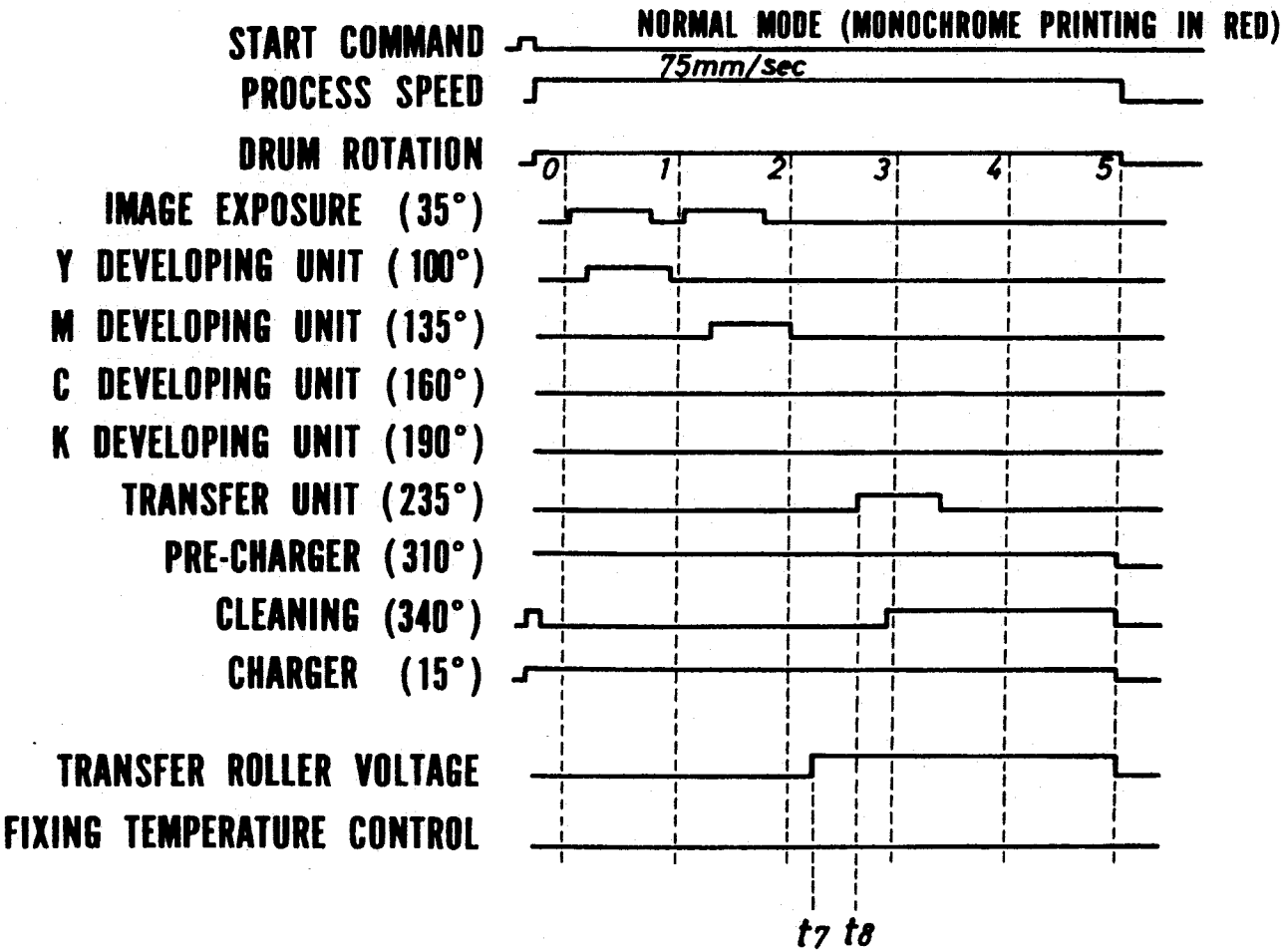
FIG. 4 is a timing chart showing an operation in the normal mode (monochrome printing in red)

FIG. 4 (monochrome printing in red in normal mode)

Substantially the same operation as that described with reference to FIG. 2 is performed. However, exposure and developing processes are performed only for Y and M images. At time t7, the switch SW1 of the constant voltage source 30 is switched to a terminal B (+1.5 kV) so as to switch the transfer roller voltage. At time t8, an urging operation of the transfer roller 10 is performed. Switching control of the process speed and the fixing temperature is not performed.

Figure 5:
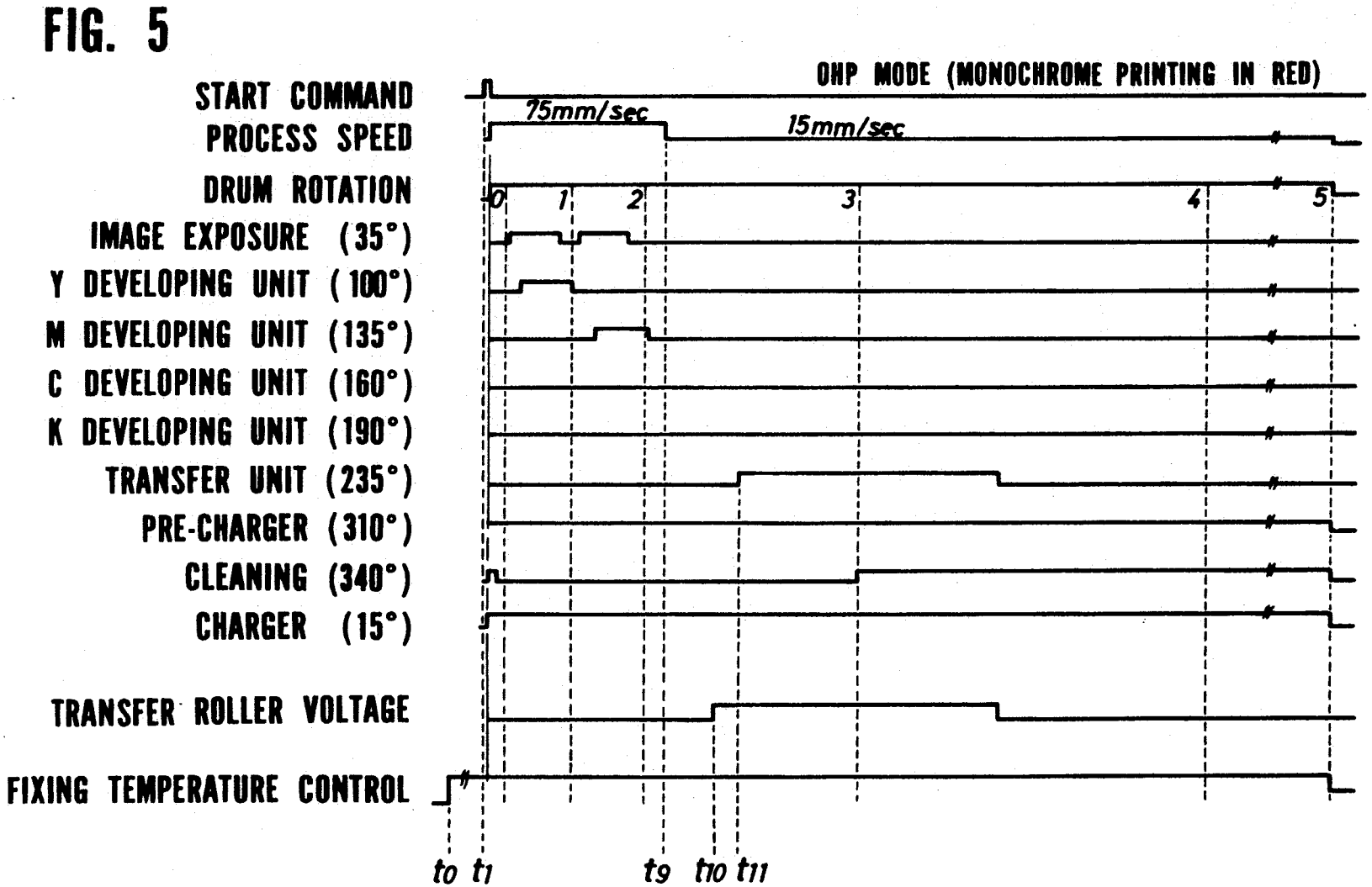
FIG. 5 is a timing chart showing an operation in the OHP mode (monochrome printing in red).

FIG. 5 (monochrome printing in red in OHP mode)

Substantially the same operation as that described with reference to FIG. 3 is performed. However, developing and exposure processes are performed for Y and M images. Since the OHP mode is set, the process speed is switched to a low speed at time t9. At time t10, the switch SW1 of the constant voltage source 30 is switched to the terminal C (+1.0 kV) to control the transfer roller voltage. At time t11, an urging operation of the transfer roller 10 is performed.

An embodiment of the present invention has been described above. Switching of fixing conditions does not necessarily include control of a fixing roller temperature. That is, the smoothness and transparency of a toner can be increased by changing only the fixing nip time upon switching of the process speed.

As has been described above, according to the present invention, after a multi-color image is formed on the photosensitive drum, the drum is rotated once more, and the process speed (the rotational speed of the drum) is changed during the rotation, thus switching process conditions. With this operation, the following effects can be obtained.

(1) The fixing performance is increased, and the smoothness and transparency of a toner are increased. Therefore, a clear color image can be displayed by a projector such as an OHP. In addition, since fixing is performed in accordance with the type of recording paper, offset, wrinkles, winding, and partial omission of characters can be prevented.

(2) Since the process speed is switched by rotating the photosensitive drum, a long distance (longer than the length of OHP paper) need not be formed between the transfer section and the fixing section. Therefore, a great reduction in size of the apparatus can be achieved.

(3) Since no paper convey mechanism is required, the arrangement of the apparatus can be simplified to realize a further reduction in cost.

(4) With the above-described advantages, a compact, low-cost full color printer and copying machine which allows a projector such as an OHP to display a clear full color image can be provided.

(5) In case plain paper is used in OHP mode, smoothness and transparency of a toner are improved, so that saturation on a chromaticity diagram will be increased and bright color images whose color reproduction area is expanded can be expressed.

What is claimed is:

1. An apparatus for forming a color image wherein toner images of a plurality of colors are formed one on another on an image carrier, transferred onto a recording medium, said apparatus comprising a speed switch for switching a process speed while said image carrier is rotating after said toner images of a plurality of colors are formed on said image carrier, a process control for controlling at least transfer conditions of said toner images onto said recording medium in response to switching of said process speed, a selector for selecting OHP mode, said speed switch including a timer for measuring time elapsed since OHP mode as selected by said selector, said control including a voltage switch for reducing a voltage applied to a transfer device when said timer measures a predetermined elapsed time.

2. The apparatus of claim 1 wherein said transfer means is a roller.

3. The apparatus of claim 1 wherein said selector includes an OHP paper detecting device for automatically selecting an OHP mode when OHP paper is detected.

4. The apparatus of claim 3 wherein said process control includes a fixing temperature control for controlling a fixing temperature of said recording medium with said toner images transferred thereon.

5. The apparatus of claim 4 wherein said image carrier rotates at least one rotation between completion of a deposition of said color transfer images on said image carrier and completion of transfer of said color toner images onto a recording medium.

6. The apparatus of claim 1 wherein said selector includes a manual selecting switch for selecting an OHP mode.

7. The apparatus of claim 6 wherein said process control includes a fixing temperature control for controlling a fixing temperature of said recording medium with said toner images transferred thereon.

8. The apparatus of claim 7 wherein said image carrier rotates at least one rotation between completion of a deposition of said color transfer images on said image carrier and completion of transfer of said color toner images onto a recording medium.

* * * * *